US005266551A

United States Patent [19]

Bailey et al.

[11] Patent Number: 5,266,551

[45] Date of Patent: Nov. 30, 1993

[54] THERMAL DYE TRANSFER RECEIVING ELEMENT WITH POLYCARBONATE POLYOL CROSSLINKED POLYMER DYE-IMAGE RECEIVING LAYER

[75] Inventors: David B. Bailey, Webster; Paul D. Yacobucci, Rochester, both of N.Y.

[73] Assignee: Eastman Kodak Company, Rochester, N.Y.

[21] Appl. No.: 923,757

[22] Filed: Aug. 3, 1992

[51] Int. Cl.[5] ..... B41M 5/035; B41M 5/38

[52] U.S. Cl. ..... 503/227; 428/195; 428/412; 428/423.1; 428/913; 428/914

[58] Field of Search ..... 503/227; 8/471; 428/195, 913, 914, 412, 423.1

[56] References Cited

U.S. PATENT DOCUMENTS 5,082,824 1/1992 Rhoades et al. ..... 503/227
5,178,953 1/1993 Anglin ..... 428/694

FOREIGN PATENT DOCUMENTS 0394460 10/1990 European Pat. Off. ..... 503/227

*Primary Examiner*—Pamela R. Schwartz
*Attorney, Agent, or Firm*—Andrew J. Anderson

[57] ABSTRACT

A dye-receiving element for thermal dye transfer includes a support having on one side thereof a dye image-receiving layer. Receiving elements of the invention are characterized in that the dye image-receiving layer primarily comprises a crosslinked polymer network formed by the reaction of multifunctional isocyanates with polycarbonate polyols having two terminal hydroxy groups and an average molecular weight of about 1000 to about 10,000.

10 Claims, No Drawings

THERMAL DYE TRANSFER RECEIVING ELEMENT WITH POLYCARBONATE POLYOL CROSSLINKED POLYMER DYE-IMAGE RECEIVING LAYER

This invention relates to dye-receiving elements used in thermal dye transfer, and more particularly to polymeric dye image-receiving layers for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus", issued Nov. 4, 1986, the disclosure of which is hereby incorporated by reference.

Dye donor elements used in thermal dye transfer generally include a support bearing a dye layer comprising heat transferable dye and a polymeric binder. Dye receiving elements generally include a support bearing on one side thereof a dye image-receiving layer. The dye image-receiving layer conventionally comprises a polymeric material chosen from a wide assortment of compositions for its compatibility and receptivity for the dyes to be transferred from the dye donor element. The polymeric material must also provide adequate light stability for the transferred dye images. Many of the polymers which provide these desired properties, however, often lack the desired strength and integrity to stand up to the rigors of thermal printing. For example, a significant problem which can be encountered during thermal printing is sticking of the dye donor to the receiver. Gloss and abrasion resistance may also be marginal with many receiving layer polymers.

Increasing the hardness of the receiver layer with polymers having higher glass transition temperatures (Tg) can improve physical properties, but penetration of the dye into such layers may be impaired.

An alternate approach to achieve improved film properties is to crosslink the polymer. Crosslinking may be achieved in a variety of different ways, including reaction curing, catalyst curing, heat curing, and radiation curing. In general, a crosslinked polymer receiver layer may be obtained by crosslinking and curing a polymer having a crosslinkable reaction group with an additive having a crosslinkable reaction group, as is discussed in EPO 394 460, the disclosure of which is incorporated by reference. This reference, e.g., discloses receiving layers comprising polyester polyols crosslinked with multifunctional isocyanates. While such crosslinked polyester receiving layers are generally superior in resistance to sticking compared to non-crosslinked polyesters, light stability for transferred image dyes may still be a problem.

It would be highly desirable to provide a receiver element for thermal dye transfer processes with a dye image receiving layer having excellent dye uptake and image stability, and which would also not stick to a dye donor after a dye image is transferred. It would be further desirable to be able to coat such a receiving layer with a minimum amount of non-chlorinated solvent.

These and other objects are achieved in accordance with this invention which comprises a dye-receiving element for thermal dye transfer comprising a support having on one side thereof a dye image-receiving layer, wherein the dye image-receiving layer primarily comprises a crosslinked polymer network formed by the reaction of multifunctional isocyanates with polycarbonate polyols having two terminal hydroxy groups and an average molecular weight of about 1000 to about 10,000.

The crosslinked polymer network formed by the reaction of multifunctional isocyanates with polycarbonate polyols may be represented by the following formula:

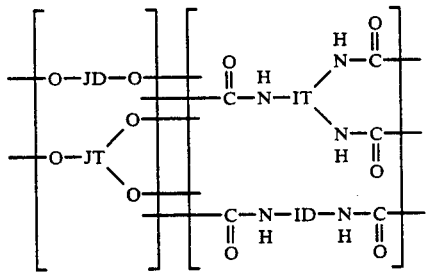

where JD and JT together represent from 50 to 100 mol % polycarbonate segments derived from polycarbonate polyols having an average molecular weight of from about 1000 to about 10,000, and ID and IT represent aliphatic, cycloaliphatic, araliphatic, or aromatic radicals of multifunctional isocyanate units.

JD represents polycarbonate segments derived from difunctional polycarbonate polyols, i.e., polycarbonate polyols having only two terminal hydroxy groups. JT represents polycarbonate segments derived from tri and higher functional polycarbonate polyols, i.e., polycarbonate polyols having additional hydroxy groups in addition to two terminal hydroxy groups. A combination of different polycarbonate segments JD and JT of similar or different molecular weights may be used. Optionally, up to a combined 50 mol % of JD and JT may represent segments derived from polyols having a molecular weight of less than about 1000, including monomeric diols (e.g., bisphenol A bis(hydroxy ethyl) ether) and triols (e.g., glycerol) or higher functional polyols (e.g., pentaerythritol). The monomeric diols provide short linkages between the isocyanate monomers and are sometimes referred to as "hard segments".

IT represents the radical of a multifunctional isocyanate containing at least three isocyanate groups, such as Desmodur N-3300 (Mobay Corp.). Higher functionality isocyanates, such as polydisperse extensions of monomeric isocyanates may also be used to create additional crosslinks. ID represents the radical of a difunctional isocyanate, such as hexamethylene diisocyanate, which may be included to extend the network without creating additional crosslinks. Preferably, at least 10 mol %, more preferably at least 50 mol %, of the isocyanate units are at least trifunctional.

Polycarbonate polyols may be represented by the following general formula:

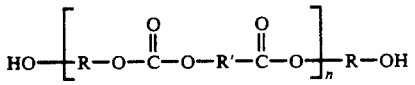

where R and R' may be the same or different and represent divalent aliphatic or aromatic radicals. The polycarbonate polyols may be formed by the reaction of a bis(chloroformate) with a diol. One of the monomers is used in excess to limit and control the molecular weight of the resulting polycarbonate polyol. As shown in the figure below, the diol is in excess and becomes the end group. Alternatively, the bis(chloroformate) could be in excess to give a chloroformate-terminated oligomer which is then hydrolyzed to form a hydroxyl end group. Therefore, polyols can be prepared from these monomers with either R and R' in excess.

General Polycarbonate Polymerization Reaction

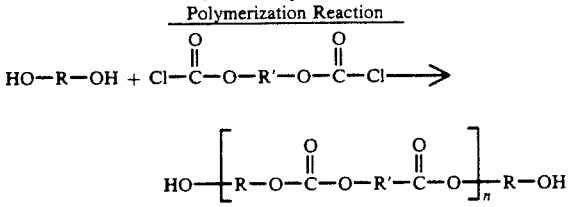

Examples of bis(chloroformates) which can be used include diethylene glycol bis(chloroformate), butanediol bis(chloroformate), and bisphenol A bis(chloroformate).

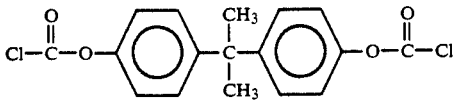

Bisphenol A bis(chloroformate)

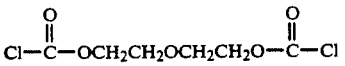

Diethylene glycol bis(chloroformate)

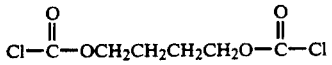

Butanediol bis(chloroformate)

Examples of diol which can be used are bisphenol A, diethylene glycol, butanediol, pentanediol, nonanediol, 4,4'-bicyclo(2,2,2)hept-2-ylidenebisphenol, 4,4'-(octahydro-4,7-methano-5H-inden-5-ylidene) bisphenol, and 2,2',6,6'-tetrachlorobisphenol A.

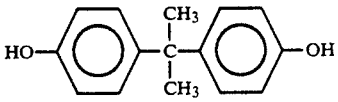

Bisphenol A

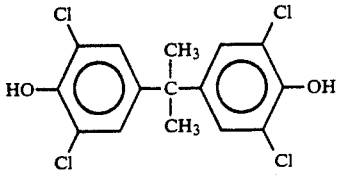

2,2',6,6'-Tetrachlorobisphenol A

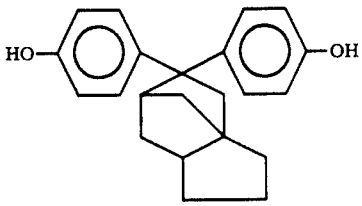

4,4'-(Octahydro-4,7-methano-5H-inden-5-ylidene)bisphenol

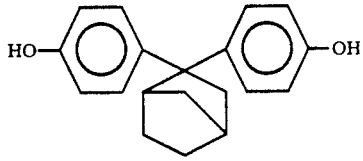

4,4'-Bicyclo(2,2,2)hept-2-ylidenebisphenol

The above monomers and other aliphatic and aromatic diols may be combined to form a variety of compositions, chain lengths and end groups. The polyol could have terminal aliphatic hydroxyl groups (e.g., diethylene glycol ends) or phenolic terminal groups (e.g., bisphenol A ends). One such structure based on bisphenol A and diethylene glycol with aliphatic hydroxyl end groups is as follows.

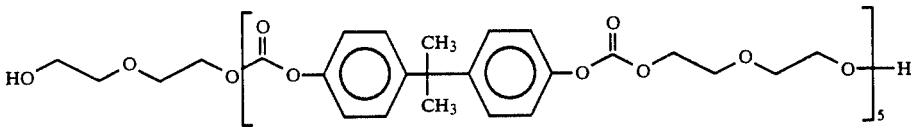

The chain length shown is 5 which would give a molecular weight of 2,040. A reasonable working range is from about 1000 to about 10,000, more preferably from about 1000 to about 5,000. Polyols of shorter chain length, or the monomers themselves, may also be incorporated into the crosslinked network.

The polycarbonate polyol is then formulated with a multifunctional isocyanate such as Desmodur N-3300 to give a crosslinked network of the general structure shown. Conventional urethane formation reaction catalysts, such as dibutylin dilaurate, may be used to facilitate the crosslinking reaction.

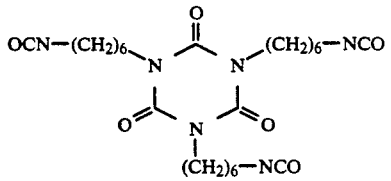

Desmodur N-3300 (Mobay Corp.)

The support for the dye-receiving element of the invention may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference.

The invention polymers may be used in a receiving layer alone or in combination with other receiving layer polymers. Receiving layer polymers which may be used with the polymers of the invention include polycarbonates, polyurethanes, polyesters, polyvinyl chlorides, poly(styrene-co-acrylonitrile), poly(caprolactone) or any other receiver polymer and mixtures thereof.

The dye image-receiving layer may be present in any amount which is effective for its intended purpose. In general, good results have been obtained at a receiver layer concentration of from about 0.5 to about 10 g/m$^2$.

While the receiving layer of the invention comprising a crosslinked polymer network formed by the reaction of multifunctional isocyanates with polycarbonate polyols inherently provides resistance to sticking during thermal printing, sticking resistance may be even further enhanced by the addition of release agents to the dye receiving layer, such as silicone based compounds, as is conventional in the art.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly-(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention. The synthesis examples are representative, and other polymers of the invention may be prepared analogously or by other methods know in the art.

Synthesis:

C1 - Preparation of polycarbonate polyol from diethylene glycol bis(chloroformate) and excess bisphenol A—terminal phenolic groups:

A 2-liter three-necked, round-bottomed flask equipped with an argon inlet, a mechanical stirrer, and an addition funnel was charged with diethylene glycol bis(chloroformate) (115.5 g, 0.5 mole), bisphenol A (137.0 g, 0.6 mole), ethyl acetate (800 ml) and cooled tO 5°-10° C. with an ice bath. A solution of triethylamine (111.3 g, 1.1 mole) in ethyl acetate (250 ml) was slowly added over a 45 min period while stirring under an argon flow. The mixture was filtered from the white precipitate, rinsed with 500 ml ethyl acetate, the combined ethyl acetate solutions were washed with 11 of water containing 15 ml of concentrated hydrochloric acid, washed three times with 11 sodium chloride solutions, and dried over anhydrous potassium carbonate. The solution was filtered, condensed on a rotary evaporator to 50 to 60% solids, and precipitated into 31 of a 50/50 methanol/ice water mixture. The soft taffy was ground in a blender with water to a hardened solid, filtered and air dried.

C7 - Preparation of polycarbonate polyol from excess diethylene glycol bis(chloroformate) and bisphenol A - terminal aliphatic hydroxyl groups:

A 1-liter three-necked, round-bottomed flask equipped with an argon inlet, a mechanical stirrer, and an addition funnel was charged with diethylene glycol bis(chloroformate) (55.4 g, 0.24 mole), bisphenol A (45.7 g, 0.2 mole), ethyl acetate (325 ml) and cooled to 5°-10° C. with an ice bath. A solution of triethylamine (40.48 g, 0.4 mole) in ethyl acetate (75 ml) was slowly added over a 45 min period while stirring under an argon flow. The mixture was filtered from the white precipitate, rinsed with ethyl acetate, the combined ethyl acetate solutions were treated with 20 ml water and 50 ml acetone followed by 12 g of pyridine to hydrolyze the chloroformate end groups. The solution was washed with 600 ml of water containing 6 ml of concentrated hydrochloric acid, washed three times with a 600 ml sodium chloride solution, and dried over anhydrous potassium carbonate. The solid polymer was isolated as in example C1.

C4 - Preparation of polycarbonate polyol using excess bisphenol A. diethylene glycol and bisphenol A bis(chloroformate) - terminal phenolic groups:

To a flask equipped with a mechanical stirrer, addition funnel, nitrogen gas inlet and a condenser was added 238.35 g (0.675 mole) of bisphenol A bis(chloroformate), 61.65 g (0.270 mole) of bisphenol A, and 66.9 g (0.63 mole) of diethylene glycol dissolved in 1125 ml of dichloromethane. The solution was cooled to 0° C., and 225 ml of pyridine slowly added with vigorous stirring. The mixture was stirred for 3 hr. at room temperature, the solid pyridine hydrochloride was removed by filtration and the product washed with 2% HCl/water followed by 2 distilled water washes. The product mixture was dried over magnesium sulfate, filtered and freed of dichloromethane under vacuum, dissolved in ethyl acetate to 50% solids and isolated as in example C1.

C8 - Preparation of polycarbonate polyol from excess diethylene glycol and bisphenol A bis(chlorofromate) - terminal aliphatic hydroxyl groups:

To a flask equipped with a mechanical stirrer, addition funnel, nitrogen gas inlet and a condenser was added 190.62 g (0.54 mole) of bisphenol A bis(chloroformate) and 63.66 g (0.60 mole) of diethylene glycol dissolved in 900 ml of dichloromethane. The solution was cooled to −20° C., and 150 ml of pyridine was slowly added with vigorous stirring. The polyol was isolated as in example C4.

C9 - Preparation of polyol using excess 1.5-pentanediol and bisphenol A bis(chloroformate) - terminal aliphatic hydroxyl groups:

To a flask equipped with a mechanical stirrer, addition funnel nitrogen gas inlet and a condenser was added 35.3 g (0.10 mole) of bisphenol A bis(chloroformate), and 11.46 g (0.11 mole ) of 1,5-pentanediol dissolved in 150 ml of dichloromethane. The solution was cooled to 0° C., and 25 ml of pyridine slowly added with vigorous stirring. The polyol was isolated as in example C4.

The polymers described in the synthesis examples above, and other similarly prepared polymers, are summarized in Table I below:

TABLE I

| | Compositions (mole %), End Groups and Molecular Weight of Polycarbonate Polyols | | | | | |
|---|---|---|---|---|---|---|
| | DIOL 1 (mol %) | DIOL 2 (mol %) | DIOL 3 (mol %) | END GROUPS | MW (F-NMR) | MW (GPC) |
| C1 | BPA 50 | DEG 50 | | Phenol | 1,695 | 1,500 |
| C2 | BPA 50 | DEG 50 | | Phenol | 2,439 | 2,210 |
| C3 | BPA 50 | DEG 50 | | Phenol | 5,714 | 4,410 |
| C4 | BPA 65 | DEG 35 | | Phenol | 2,062 | 2,035 |
| C5 | BPA 50 | DEG 50 | | Aliphatic | 1,709 | 1,730 |
| C6 | BPA 50 | DEG 50 | | Aliphatic | 1,923 | 1,905 |
| C7 | BPA 50 | DEG 50 | | Aliphatic | 3,125 | 2,535 |
| C8 | BPA 50 | DEG 50 | | Aliphatic | 3,846 | 2,835 |
| C9 | BPA 50 | PDO 50 | | Aliphatic | 3,030 | 2,570 |
| C10 | BPA 50 | NDO 50 | | Aliphatic | 4,167 | 3,285 |
| C11 | BPA 25 | GK 25 | DEG 50 | Phenol | 1,923 | 1,600 |
| C12 | BPA 25 | GK 25 | DEG 50 | Phenol | 2,941 | 2,110 |
| C13 | BPA 25 | TCBPA 25 | DEG 50 | Phenol | 1,250 | 1,945 |

BPA is bisphenol A, DEG is diethylene glycol, PDO is 1,5-pentanediol, NDO is 1,9-nonanediol, GK is 4,4'-(octahydro-4,7-methano-5H-inden-ylidene) bisphenol, TCBPA is 2,2',6,6'-tetrachlorobisphenol A.

The molecular weight by F-NMR is derived from a count of the end groups assuming two hydroxyls per chain. The hydroxyl ends are converted to trifluoroacetates and assayed by F-NMR. GPC gel permeation chromatography) is a size exclusion technique which measures the size or length of the chain. The reasonably good agreement indicates there are approximately two hydroxyl end groups per chain.

Examples

Dye-receiver elements were prepared by coating the following layers in order on white-reflective supports of titanium dioxide pigmented polyethylene overcoated paper stock;

(1) Subbing layer of poly(acrylonitrile-covinylidene chloride-co-acrylic acid) (14:79:7 wt. ratio) (0.08 g/m$^2$) from butanone.

(2) Dye-receiving layer of the indicated crosslinked invention or control polymers containing Fluorad FC-431 dispersant (3M Corp) and diphenyl phthalate plasticizer. Invention polymers were coated from ethyl acetate; control polymers were coated from dichloromethane.

Dye receiving layer crosslinked coatings of the polycarbonate polyols C1-C13 and polyester polyols E1-E2 (described below) were prepared with Desmodur N-3300 (Mobay Corp.) as the polyisocyanate. The amount of Desmodur N-3300 was adjusted such that the equivalents of polyol hydroxyl groups were 80% of the equivalents of isocyanate groups. In the case of Cl, higher and lower hydroxyl/isocyanate percentages of 100% (C1-100) and 60% (C1-60) were also prepared in addition to 80% (C1-80).

The catalyst for the isocyanate-polyol reaction was dibutyltin dilaurate at a level of 2 wt % based on Desmodur N-3300. In all cases, 10 wt % of diphenyl phthalate plasticizer and 0.125 wt % of FC431 (3M Co.) surfactant were added based on the dry solids. The overall solids content of the coating solution was the wet laydown was 25 microns, and the dry laydown was 0.54 to 0.65 g/m$^2$. The films were dried in an oven at 70° C. for 1 day.

The high molecular weight polycarbonate analogs H1-H4 (described below) were coated with no catalyst or crosslinking agent, but the coatings did contain the same level of diphenyl phthalate plasticizer and FC431 (3M Co.) surfactant. Due to the high viscosity, the solutions were prepared at 5% solids and coated at a wet laydown of 100 microns to achieve a dry laydown of 0.54 to 0.65 g/m$^2$.

Polyester polyol E1

To a flask equipped with a mechanical stirrer, dropping funnel, nitrogen gas inlet and a condenser were added 33.95 g (0.32 mole) of diethylene glycol, 18.26 g (0.08 mole) of bisphenol A and 66 g (0.65 mole) of triethylamine dissolved in 200 ml of dichloromethane. The solution was cooled to 0° C., and a solution of 60.9 g (0.30 mole) of isophthaloyl chloride dissolved in 200 ml dichloromethane was slowly added with stirring. The mixture was stirred for 24 hr at room temperature. The polyol was isolated as in example C4. The main chain of the polyester is shown below:

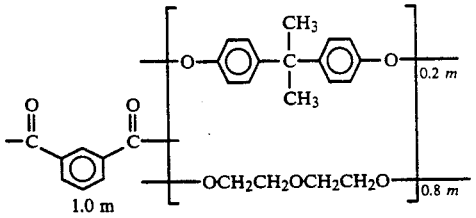

The end groups are a combination of aliphatic and aromatic hydroxyl groups. The molecular weights as determined by end group analysis and gel permeation chromatography were similar (2,597 and 2,385, respectively).

Polyester polyol E2:

To a flask equipped with a mechanical stirrer, dropping funnel, nitrogen gas inlet and a condenser were added 6.21 g (0.1 mole) of ethylene glycol, 31.64 g (0.1 mole) of bisphenol A bis(hydroxyethyl) ether and 40.0 g (0.395 mole) of triethylamine dissolved in 100 ml of dichloromethane. The solution was cooled to 0° C., and a solution of 30.45 g (0.15 mole) of terephthaloyl chloride dissolved in 100 ml dichloromethane slowly added with stirring. The mixture was stirred for 24 hr at room temperature. The polyol was isolated as in example C4. The main chain of the polyester is shown below:

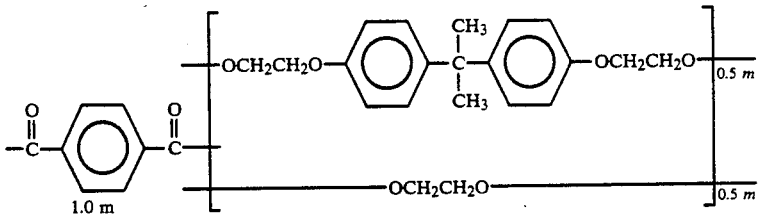

The end groups are aliphatic hydroxyls. The molecular weights by end group analysis and gel permeation chromatography were similar (2,353 and 1,720, respectively).

TABLE II

| | High Molecular Weight Polycarbonates | | | |
|---|---|---|---|---|
| | DIOL 1 (mol %) | DIOL 2 (mol %) | DIOL 3 (mol %) | GPC MW |
| H1 | BPA 50 | DEG 50 | | 196,000 |
| H2 | BPA 65 | DEG 35 | | 260,000 |
| H3 | BPA 25 | GK 25 | DEG 50 | 96,100 |
| H4 | BPA 25 | GJ 25 | DEG 50 | 100,000 |

GJ is 4,4'-bicyclo(2,2,2)hept-2-ylidenebisphenol; the remaining acronyms are as defined for Table I.

An important advantage of the polycarbonate polyols (C1-C13) relative to the high-molecular weight polycarbonates (H1-H4) and the polyester polyols (E1-E2) is their solubility in ethyl acetate, a much less hazardous solvent than dichloromethane. As a result, handling and solvent recovery during the coating operation are greatly simplified. Furthermore, the low-molecular weight polyols can be coated at much higher solids contents (24%) than their high-molecular weight analogs (5%). As can be seen in Table III, the solution viscosity of the polyols is low compared to that of the polymers even though the solids contents are higher. The more concentrated solutions allow one to achieve lower wet laydowns and less solvent is needed to achieve the same dry coating thickness.

TABLE III

| SAMPLE | SOLUTION VISCOSITY (CPS) | SOLVENT* | SOLIDS (%) |
|---|---|---|---|
| C1-60 | 2.3 | EtAc | 24% |
| C1-80 | 2.3 | EtAc | 24% |
| C1-100 | 3.0 | EtAc | 24% |
| C2 | 4.6 | EtAc | 24% |
| C3 | 10.9 | EtAc | 24% |
| C4 | 5.2 | EtAc | 24% |
| C5 | 3.1 | EtAc | 24% |
| C6 | 3.5 | EtAc | 24% |
| C7 | 4.2 | EtAc | 24% |
| C8 | 6.3 | EtAc | 24% |
| C9 | 7.1 | EtAc | 24% |
| C10 | 14.4 | EtAc | 24% |
| C11 | 3.8 | EtAc | 24% |
| C12 | 4.7 | EtAc | 24% |
| C13 | 3.2 | EtAc | 24% |
| E1 | 3.8 | DCM | 24% |
| E2 | 3.7 | DCM | 24% |
| H1 | 52.1 | DCM | 5% |
| H2 | 17.3 | DCM | 5% |
| H3 | 17.0 | DCM | 5% |
| H4 | 17.3 | DCM | 5% |

*EtAc is ethyl acetate, DCM is dichloromethane.

A dye donor element of sequential areas of cyan, magenta and yellow dye was prepared by coating the following layers in order on a 6 μm poly(ethylene terephthalate) support:

(1) Subbing layer of Tyzot TBT (titanium tetra-n-butoxide) (duPont Co.) (0.12 g/m$^2$) from a n-propyl acetate and 1-butanol solvent mixture.

(2) Dye-layer containing Cyan Dye 1 (0.42 g/m2) illustrated below, a mixture of Magenta Dye 1 (0.11 g/m2) and Magenta Dye 2 (0.12 g/m2) illustrated below, or Yellow Dye 1 illustrated below (0.20 g/m$^2$) and S-363N1 (a micronized blend of polyethylene, polypropylene and oxidized polyethylene particles) (Shamrock Technologies, Inc.) (0.02 g/m$^2$) in a cellulose acetate propionate binder (2.5% acetyl, 46% propionyl) (0.15–0.70 g/m$^2$) from a toluene, methanol, and cyclopentanone solvent mixture.

On the reverse side of the support was coated:

(1) Subbing layer of Tyzor TBT (0.12 g/m$^2$) from a n-propyl acetate and 1-butanol solvent mixture.

(2) Slipping layer of Emralon 329 (a dry film lubricant of poly(tetrafluoroethylene) particles in a cellulose nitrate resin binder) (Acheson Colloids Corp.) (0.54 g/m2), p-toluene sulfonic acid (0.0001 g/m2), BYK-320 (copolymer of a polyalkylene oxide and a methyl alkylsiloxane) (BYK Chemie, USA) (0.006 g/m2), and Shamrock Technologies Inc. S-232 (micronized blend of polyethylene and carnauba wax particles) (0.02 g/m2), coated from a n-propyl acetate, toluene, isopropyl alcohol and n-butyl alcohol solvent mixture.

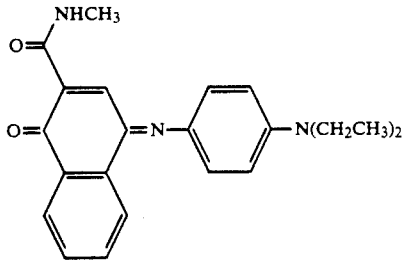

(Cyan Dye 1)

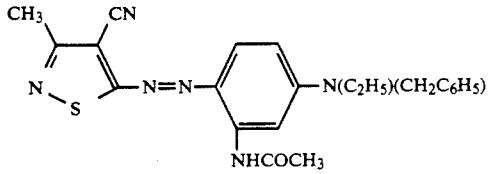

(Magenta Dye 1)

-continued

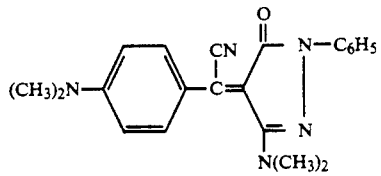

(Magenta Dye 2)

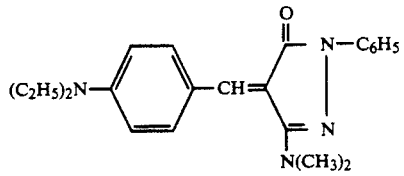

(Yellow Dye 1)

The dye side of the dye-donor element approximately 10 cm×13 cm in area was placed in contact with the polymeric receiving layer side of the dye-receiver element of the same area. The assemblage was fastened to the top of a motor-driven 56 mm diameter rubber roller and a TDK Thermal Head L-231, thermostated at 22° C., was pressed with a spring at a force of 36 Newtons against the dye-donor element side of the assemblage pushing it against the rubber roller.

the imaging electronics were activated and the assemblage was drawn between the printing head and roller at 7.0 mm/sec. coincidentally, the resistive elements in the thermal print head were pulsed in a determined pattern for 20 μsec/pulse at 129 μsec intervals during the 33 msec/dot printing time to create an image. When desired, a stepped density image was generated by incrementally increasing the number of pulses/dot from 0 to 255. The voltage supplied to the print head was approximately 24.5 volts, resulting in an instantaneous peak power of 1.27 watts/dot and a maximum total energy of 9.39 mjoules/dot.

Individual cyan, magenta and yellow images were obtained by printing from three dye-donor patches. When properly registered a full color image was formed. The Status A red, green, and blue reflection density of the stepped density image at maximum density, Dmax, were read and recorded.

The step of each dye image nearest a density of 1.0 was then subjected to exposure for 1 week, 50 kLux, 5400° K., approximately 25% RH. The Status A red, green and blue reflection densities were compared before and after fade and the percent density loss was calculated. The results are presented in Table IV.

TABLE IV

| | FADE | | | DMAX | | |
|---|---|---|---|---|---|---|
| | YELLOW | MAGENTA | CYAN | YELLOW | MAGENTA | CYAN |
| C1-60 | 9% | 12% | 13% | 2.45 | 2.81 | 2.55 |
| C1-80 | 7% | 14% | 11% | 2.53 | 2.92 | 2.62 |
| C1-100 | 11% | 17% | 13% | 2.48 | 2.83 | 2.63 |
| C2 | 8% | 13% | 11% | 2.49 | 2.78 | 2.41 |
| C3 | 7% | 14% | 7% | 2.22 | 2.43 | 2.51 |
| C4 | 10% | 11% | 7% | 2.46 | 2.77 | 2.64 |
| C5 | 3% | 5% | 2% | 2.50 | 2.77 | 2.44 |
| C6 | 5% | 10% | 4% | 2.44 | 2.81 | 2.59 |
| C7 | 0% | 1% | 2% | 2.49 | 2.78 | 2.64 |
| C8 | 3% | 4% | 0% | 2.51 | 2.81 | 2.71 |
| C9 | 7% | 13% | 12% | 2.67 | 2.74 | 2.70 |
| C10 | 12% | 20% | 31% | 2.72 | 2.88 | 2.79 |
| C11 | 20% | 35% | 14% | 2.37 | 2.71 | 2.43 |
| C12 | 20% | 20% | 17% | 2.16 | 2.31 | 2.38 |
| C13 | 23% | 19% | 22% | 2.42 | 2.74 | 2.40 |
| E1 | 39% | 24% | 69% | 2.50 | 2.91 | 2.74 |

TABLE IV-continued

| | FADE | | | DMAX | | |
|---|---|---|---|---|---|---|
| | YELLOW | MAGENTA | CYAN | YELLOW | MAGENTA | CYAN |
| E2 | 70% | 64% | 72% | 2.41 | 2.79 | 2.55 |
| H1 | 2% | 4% | 9% | 2.52 | 2.87 | 2.66 |
| H2 | 13% | 17% | 6% | 2.47 | 2.81 | 2.73 |
| H3 | 8% | 13% | 4% | 2.36 | 2.62 | 2.63 |
| H4 | 8% | 9% | 2% | 2.49 | 2.68 | 2.63 |

The quality of the final image is to a great extent determined by the density and the stability of the image under high intensity light conditions. As can be seen in Table IV, the crosslinked polycarbonate polyols are superior to the crosslinked polyester polyols for fade. In all cases the Dmax is more than adequate.

Sticking of donor to receiver is a problem that is most evident in the mid scale of a neutral step chart. Sticking can be felt as a tugging of the donor as it is pulled from the receiver or, in severe cases, it can be seen as actual donor particles transferred to the receiver. Sticking can be quantified by attaching a force measuring device to the donor and recording the force needed to peel it from the receiver.

A peel rig for a thermal sensitometer was fabricated to measure the peel force required to remove a donor from a receiver immediately after the third color printing of a yellow, magenta, cyan sequence. Before printing, the leading edge of the donor web was attached to a take-up or torque tube. The tube had the same diameter as the printing drum and was attached to a 1.8 kg-cm (25 oz-in) Himmelstein torque gauge. The drive mechanism was the same as that used to drive the printer, i.e. a stepper motor attached to a drive box. The same signal was used to drive both the print drum and the take-up drum such that they both moved in synchronization. The signal from the torque gauge was processed and recorded. Prints were made, and as the print drum rotated, the torque gauge pulled the donor off the receiver at the same rate as the print rate, 6.4 mm/sec. The force over the entire printing width was measured. The recorded voltage was converted to force per unit width using a determined calibration factor, and the results are presented in Table V.

TABLE V

| SAMPLE | PEEL FORCE (N/M) |
|---|---|
| C1-60 | 1 |
| C1-80 | 2 |
| C1-100 | 1 |
| C2 | 1 |
| C3 | 2 |
| C4 | 1 |
| C5 | 1 |
| C6 | 1 |
| C7 | 9 |
| C8 | 2 |
| C9 | 1 |
| C10 | 4 |
| C11 | 2 |
| C12 | 6 |
| C13 | 2 |
| E1 | 10 |
| E2 | 0 |
| H1 | 25 |
| H2 | 14 |
| H3 | 27 |
| H4 | 33 |

As can be seen in Table V, the crosslinked polyols are far superior to their high molecular weight analogs. In the H1 to H4 samples, actual transfer of specks of donor to receiver occurred. In the polyol examples, no donor specks were found.

Relative to the high molecular weight linear polycarbonates of similar structure, the crosslinked films of low-molecular weight polycarbonate polyols are much less prone to sticking during printing. In addition, the polyols are soluble in ethyl acetate and have coatable solution viscosities at much higher solids contents than do the linear analogs. Relative to crosslinked polyester polyols, these materials provide superior light stability for transferred dye images.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof a dye image-receiving layer, wherein the dye image-receiving layer consists essentially of a crosslinked polymer network alone or in combination with other dye image-receiving layer polymers, said crosslinked polymer network being formed by the reaction of multifunctional isocyanates with polycarbonate polyols having two terminal hydroxy groups and an average molecular weight of about 1000 to about 10,000.

2. The element of claim 1, wherein the crosslinked polymer network is of the formula:

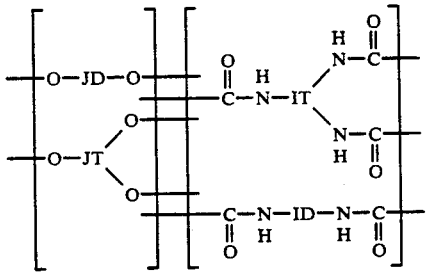

wherein

JD and JT together represent from 50 to 100 mol % polycarbonate segments derived from polycarbonate polyols having an average molecular weight of from about 1000 to about 10,000 and from 0 to 50 mol % segments derived from polyols having a molecular weight of less than about 1000, and ID and IT represent aliphatic, cycloaliphatic, araliphatic, or aromatic radicals of multifunctional isocyanate units.

3. The element of claim 1, wherein the polycarbonate polyols comprise bisphenol A derived units and diethylene glycol derived units.

4. The element of claim 1, wherein the terminal hydroxy groups of the polycarbonate polyols comprise aliphatic hydroxyl groups.

5. The element of claim 1, wherein the terminal hydroxy groups of the polycarbonate polyols comprise phenolic groups.

6. The element of claim 1, wherein the terminal hydroxy groups of the polycarbonate polyols comprise a mixture of phenolic groups and aliphatic hydroxyl groups.

7. The element of claim 1, wherein at least 50 mol % of the multifunctional isocyanates are at least trifunctional.

8. The element of claim 1, wherein the polyols and multifunctional isocyanates are reacted to form the crosslinked polymer network in amounts such that the equivalents of polyol hydroxyl groups are from 60 to 100% of the equivalents of isocyanate groups.

9. A process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, wherein the dye image-receiving layer comprises a crosslinked polymer network formed by the reaction of multifunctional isocyanates with polycarbonate polyols having two terminal hydroxy groups and an average molecular weight of about 1000 to about 10,000.

10. A thermal dye transfer assemblage comprising: (a) a dye-donor element comprising a support having thereon a dye layer and (b) a dye-receiving element comprising a support having thereon a dye image-receiving layer, said dye-receiving element being in a superposed relationship with said dye-donor element so that said die layer is in contact with said dye image-receiving layer; wherein the dye image-receiving layer comprises a crosslinked polymer network formed by the reaction of multifunctional isocyanates with polycarbonate polyols having two terminal hydroxy groups and an average molecular weight of about 1000 to about 10,000.

* * * * *